US006102835A

United States Patent [19]

Webber

[11] Patent Number: 6,102,835

[45] Date of Patent: Aug. 15, 2000

[54] WEIGHT STACK HOUSING FOR EXERCISE MACHINE

[76] Inventor: Randall T. Webber, 11162 Morning Creek Dr. South, San Diego, Calif. 92128

[21] Appl. No.: 09/015,554

[22] Filed: Jan. 29, 1998

[51] Int. Cl.[7] ..... A63B 21/06

[52] U.S. Cl. ..... 482/98; 482/99

[58] Field of Search ..... 482/94, 98–103, 482/138; D21/675

[56] References Cited

U.S. PATENT DOCUMENTS

| | | | |
|---|---|---|---|
| D. 301,597 | 6/1989 | Lehtonen | D21/675 |
| D. 303,558 | 9/1989 | Alessandri . | |
| 5,338,274 | 8/1994 | Jones . | |
| 5,665,036 | 9/1997 | Hsieh | 482/100 |

OTHER PUBLICATIONS

Muscle Dynamics brochure.
Hoist 760XT brochure.
Life Fitness.
Pacific Fitness "Monterey".
Tuff Stuff TLM–85WS.
Cybek Strength Systems "Modular" Brochure, ©1994.
Hoist Fitness Systems "Multi Function Home Gym" Brochure, ©1993.

*Primary Examiner*—John Mulcahy
*Attorney, Agent, or Firm*—Brown, Martin, Haller & McClain, LLP

[57] ABSTRACT

A weight stack housing for an exercise machine is formed in two parts. The first part is an elongate, three sided shield body having a rear wall and a pair of side walls, and an open front, the shield body forming a three sided enclosure for a weight stack assembly and being adapted for attachment between the top and bottom of the frame of an exercise machine behind a user access area or seat. The second part is a U-shaped front support bracket secured between the side walls of the shield body to extend across the open front of the shield body at a location spaced above the weight stack pinning area. The support bracket has an outwardly facing attachment device for attaching a cable to the support bracket, to keep cable away from the weight stack pinning or adjustment area.

9 Claims, 3 Drawing Sheets

WEIGHT STACK HOUSING FOR EXERCISE MACHINE

BACKGROUND OF THE INVENTION

The present invention relates generally to exercise machines of the weight lifting type in which various exercise devices are linked to an adjustable weight stack by means of a pulley and cable system to provide resistance to exercises performed at the various devices. The invention is particularly concerned with a housing for the weight stack of such a machine.

Conventional weight stacks normally comprise a stack of brick-like weights slidably mounted on one or more guide rods extending between the top and bottom of the support frame of the exercise machine. The top of the weight stack is suitably linked to the cable and pulley system connecting the stack to the various exercise devices or stations. Each weight has an opening accessible to the user and a pull pin is inserted in a selected opening to determine how many weights in the stack are to be lifted along the guide rods when a user performs an exercise.

In the past, such weight stacks have been completely open in some cases, but this may potentially case injuries to bystanders. In some machines, the weight stack is enclosed in shields that cover all or a portion of the stack in order to reduce possible injury. However, such shields may limit access to the weights for adjustment purposes. The weight stack, with or without a shield or housing, is normally mounted to the rear of the machine, behind the seat which is used for performing exercises in a seated or reclined position. A problem with mounting the weight stack in line with the exercise position is that downward cables running in front of the weight stack will limit access to the weights. In the past, this problem has been avoided by offsetting either the cables or the weight stack from the center line of the machine. If the weight stack is offset to one side, the cables will not interfere with access. However, this is a more expensive approach and also increases the size of the machine, and thus the floor space needed to accommodate it.

Another prior art solution to the problem of weight stack location has been to locate the stack in-line with the machine, i.e. directly behind a seated user, and to direct the cable path far enough to one side to avoid the weight pinning area. However, this is not desirable since cable should run on center for smoother operation and longer life. Another prior art solution is to mount the weight stack so that the pinning area faces backwards, away from the machine, to avoid any cable interference. This also increases floor space requirements to accommodate the machine, since sufficient space must be left behind the machine to provide the user with access to the pinning area for adjustment of the weight or resistance. Thus, the machine cannot be positioned against a wall.

SUMMARY OF THE INVENTION

It is an object of the present invention to provide a new and improved weight stack housing for an exercise machine.

It is a further object of the present invention to provide a new and improved exercise machine incorporating a centrally mounted weight stack and housing.

According to a first aspect of the present invention, a weight stack housing for an exercise machine is provided, which comprises an elongate, three sided shield body having a rear wall and a pair of side walls, and an open front, the shield body being adapted for attachment between the top and bottom of the frame of an exercise machine surrounding a weight stack and weight stack guide rods, and a U-shaped front support bracket secured between the side walls of the shield body to extend across the open front of the shield at a location spaced above the weight stack pinning area, the support bracket having an outwardly facing attachment device for attaching a cable to the support bracket.

The attachment device may comprise a device for tying off, or dead-ending, a cable, such as a fastener sleeve in which the cable end is fastened by means of an adjustable bolt for adjusting cable tension. Alternatively, the attachment device may comprise a pulley secured to the front of the support bracket, for re-directing cable away from the front of the weight stack. In either case, the cable will not run directly in front of the pinning area of the weight stack, but will be directed or secured away from this area, allowing easier access to the weights.

According to another aspect of the present invention, an exercise apparatus is provided which comprises a support frame having an upper end, a lower end, a front end and a rear end, at least one exercise device mounted on the frame for permitting a user to perform exercises, a user access area on the frame for user access to the exercise device, a weight stack assembly mounted on the frame behind and in line with the user access area, the weight stack assembly having a pinning area facing the upright member for adjustment of the exercise resistance, a cable and pulley assembly linking the exercise device to the weight stack assembly, and a shield enclosure extending between the upper and lower end of the frame and surrounding the weight stack assembly on three sides, the enclosure comprising a main body having a rear wall, spaced side walls, and an open front facing the user access area, and a front bracket secured between the body side walls to extend across the open front of the main body at a location spaced above the weight stack pinning area, the front bracket having a cable attachment device facing the user access area for locating a cable above the pinning area.

As noted above, the cable attachment device may comprise a fastener for fastening the end of a cable to the front bracket, or a pulley for re-directing a cable away from the front of a weight stack. In either case, easy access to the weight stack pinning area is provided without any interference from cables, and without requiring any offset of the cables from the center line of the apparatus. This arrangement avoids the need to offset either the weight stack or the cables from the center line of the exercise apparatus, both of which would increase the size of the apparatus, and also avoids the need for directing the weight stack pinning area to the rear of the apparatus. The use of a front support bracket to re-direct cable away from the pinning area avoids a number of the disadvantages of prior art weight stack and enclosure arrangements.

Another advantage of the front bracket is that it acts as a stiffener for the open-fronted, main body of the weight stack enclosure. Preferably, the front bracket is generally U-shaped or three-sided, for strength and ease of assembly. The side walls of the bracket are secured to the corresponding side walls of the main body, resisting flexing of the side walls under heavy loads. The front bracket is preferably releasably secured to the main body for easy installation and service of the weight stack.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENT

Figure 1:
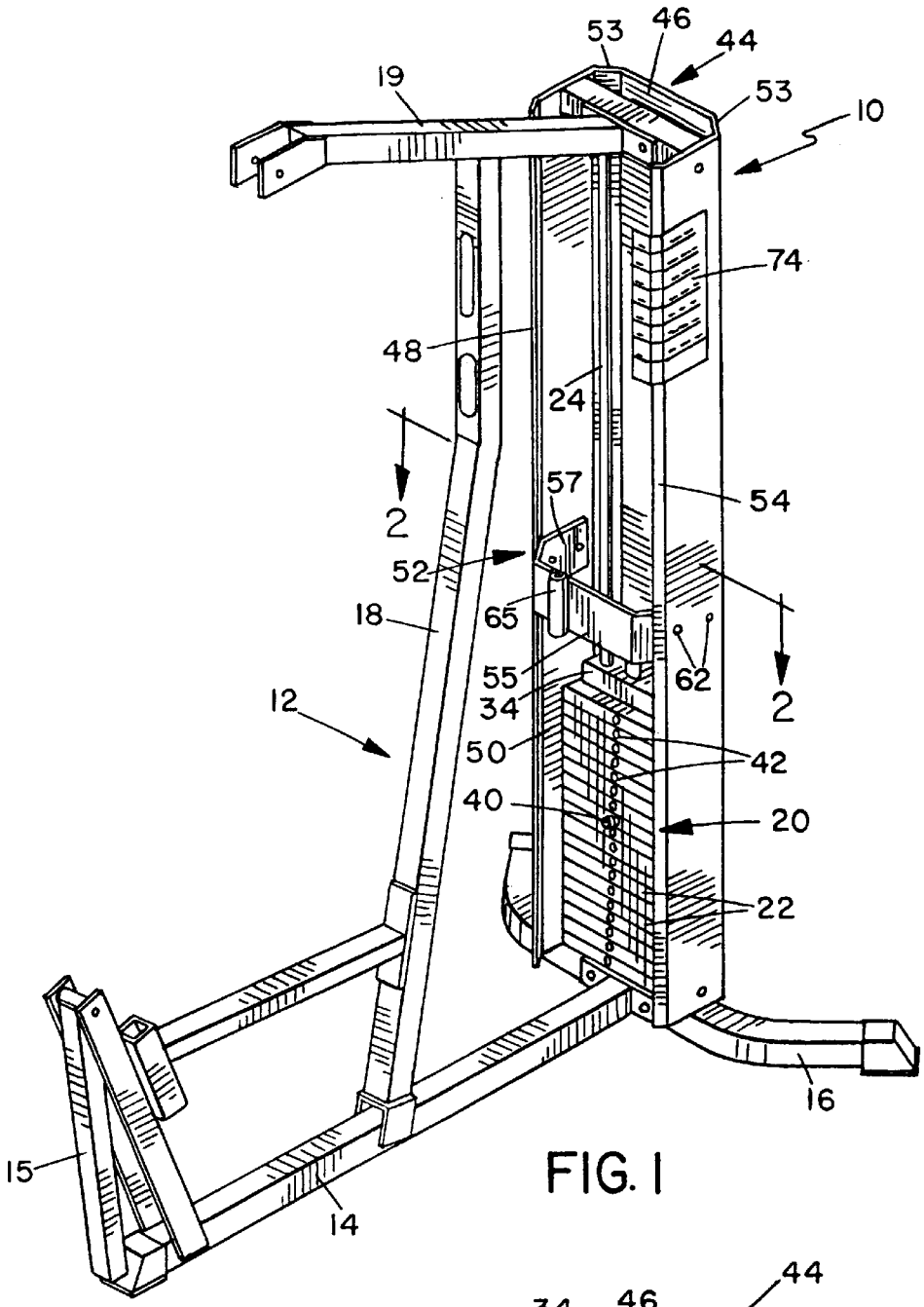
FIG. 1 is a perspective view of a weight stack housing according to a first embodiment of the invention mounted in the basic frame of an exercise machine.

FIGS. 1 to 3, 6 and 7 of the drawings illustrate a weight stack housing or assembly 10 according to a first embodiment of the present invention mounted on the frame 12 of an exercise machine. As best illustrated in FIG. 1, the basic frame 12 comprises a base 14 having a forward end 15 and a rear end 16, an upright member 18 extending upwardly from the base on the center line of the machine, and an upper strut 19 extending across the upper end of the machine. A conventional weight stack 20 comprising a plurality of stacked weights 22 is supported on the rear end of the base, and the weights are slidably mounted on a pair of guide rods 24 extending between the base and upper strut 19, as best illustrated in FIGS. 1,2,6 and 7.

Figure 3:
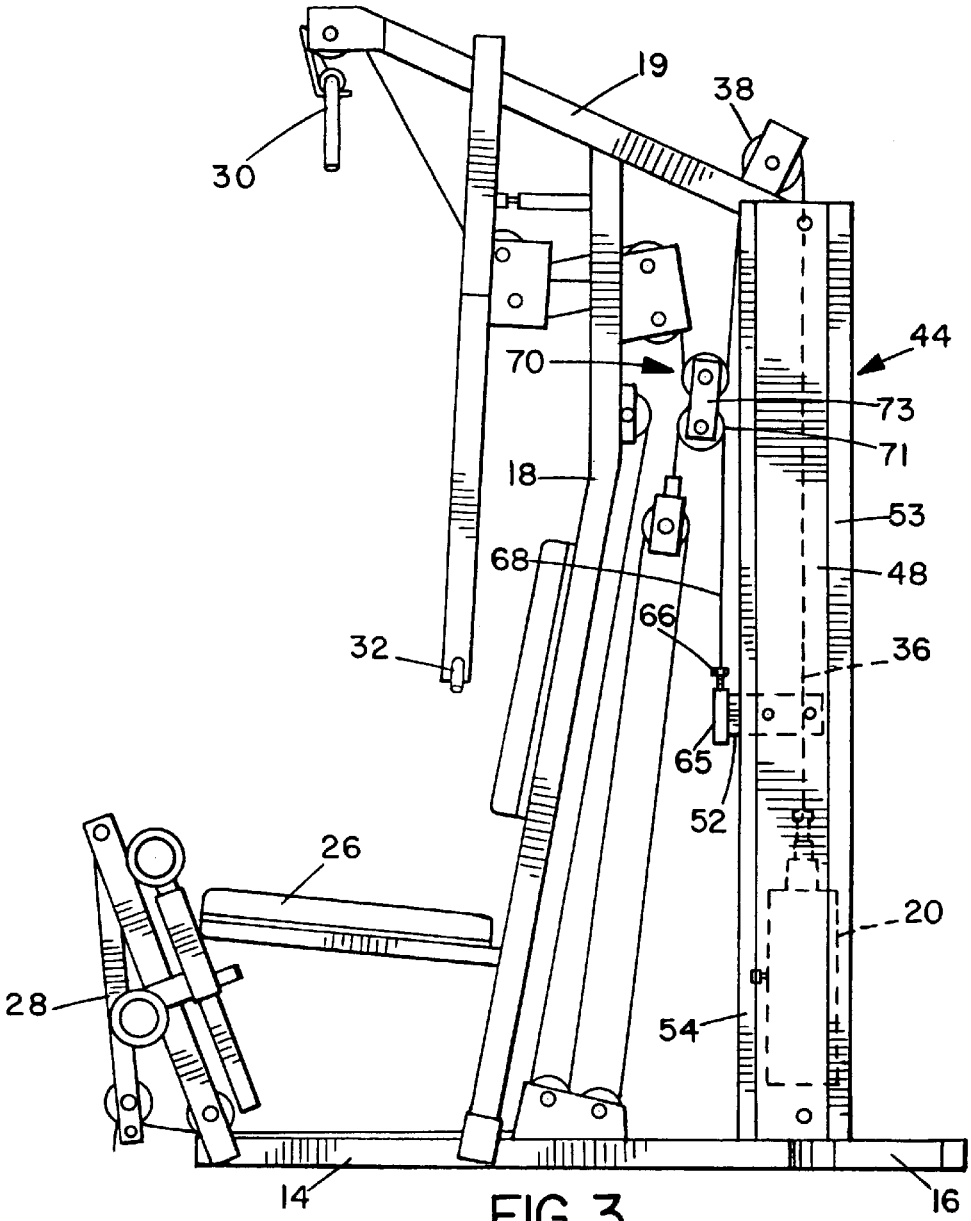
FIG. 3 is a side view of the housing in a complete machine.

Typically, a user access area such as a seat 26 is located in front of the upright member 18, as indicated in FIG. 3. The machine may be provided with one or more exercise stations for performing different types of exercises. In the example of FIG. 3, a leg extension station 28 is provided in front of the seat 26, and a pull down station 30 and chest press station 32 are suspended from the upper strut 19 above the user access area. Each exercise station is secured to a bracket or plate 34 at the upper end of the weight stack via a cable and pulley assembly which links each exercise station along a cable path from the exercise station to a final cable 36 extending around a pulley 38 at the rear end of the upper strut and down to the plate 34, as best illustrated in FIG. 3. The user can select the desired weight or exercise resistance by placing a removable pull pin 40 in an opening 42 provided in the front of each of the weights, determining how many weights will be lifted when the user performs an exercise to pull up on cable 36.

The weight stack housing 10 basically comprises a main body or shield 44 having a rear wall 46, spaced side walls 48, and an open front 50, and a front bracket 52 secured across the open front 50. The main body or enclosure extends between the base 14 and the upper strut 19 of the frame so as to enclose the weight stack and guide rods 24 on three sides, with the open front 50 facing the upright member 18 and the user access area defined by the seat. The upper and lower ends of the main body of the housing are suitably secured to the upper strut and base of the frame by bolted end plates or the like, as generally indicated in FIG. 1. In the illustrated embodiment, the bracket 52 is relatively narrow, and the front of the housing is left open both above and below bracket 52. In an alternative embodiment, the bracket 52 may extend up to the top of housing 10, leaving an opening below the bracket only for access to the weight stack.

Figure 2:
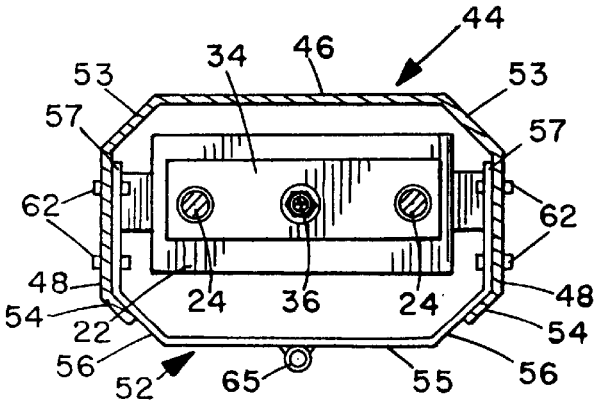
FIG. 2 is an enlarged sectional view taken on line 2—2 of FIG. 1.

The weight stack and housing are mounted directly behind the user access area and centered on the center line of the frame, as best illustrated in FIG. 1. The main body and front bracket of the housing are preferably each generally U-shaped in cross-section, as best illustrated in FIG. 2. In the embodiment of FIG. 2, the main body has angled corner portions 53 between each side wall 48 and the rear wall 46, for increased strength and rigidity, and an inwardly angled rim 54 at the front end of each side wall. The bracket is of similar cross-sectional shape, with a front side 55, angled corner portions 56, and side walls 57. This produces a generally eight sided enclosure or housing for the weight stack.

Figure 4:
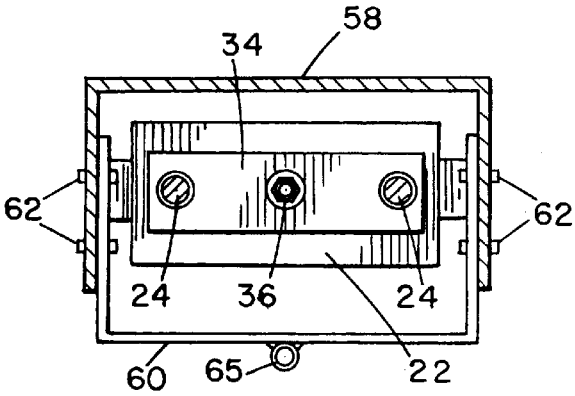
FIG. 4 is a view similar to FIG. 2, showing an alternative configuration of the housing.

In an modified embodiment, as illustrated in FIG. 4, the housing may be formed from a three-sided main body 58 and a three sided front bracket 60, eliminating the angled corner portions 54 and 56, respectively. However, the alternative of FIG. 2 is preferred since the shield or enclosure will be stronger and more rigid as the number of sides is increased.

Figure 6:
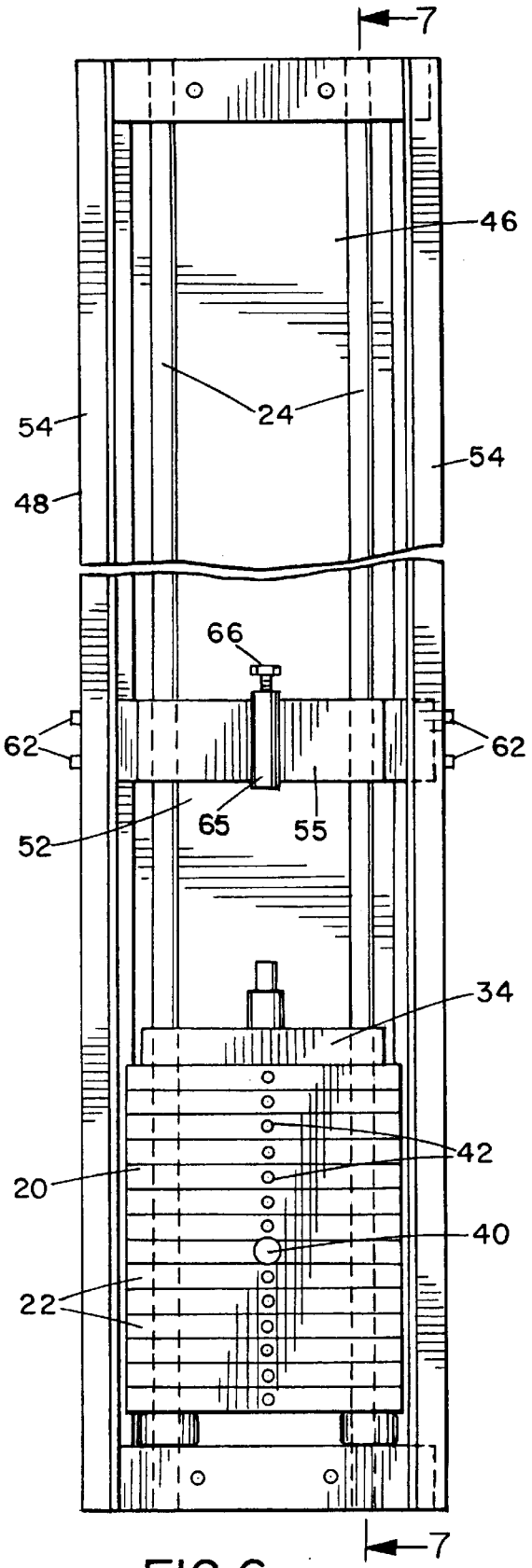
FIG. 6 is an enlarged front view of the housing and weight stack.
Figure 7:
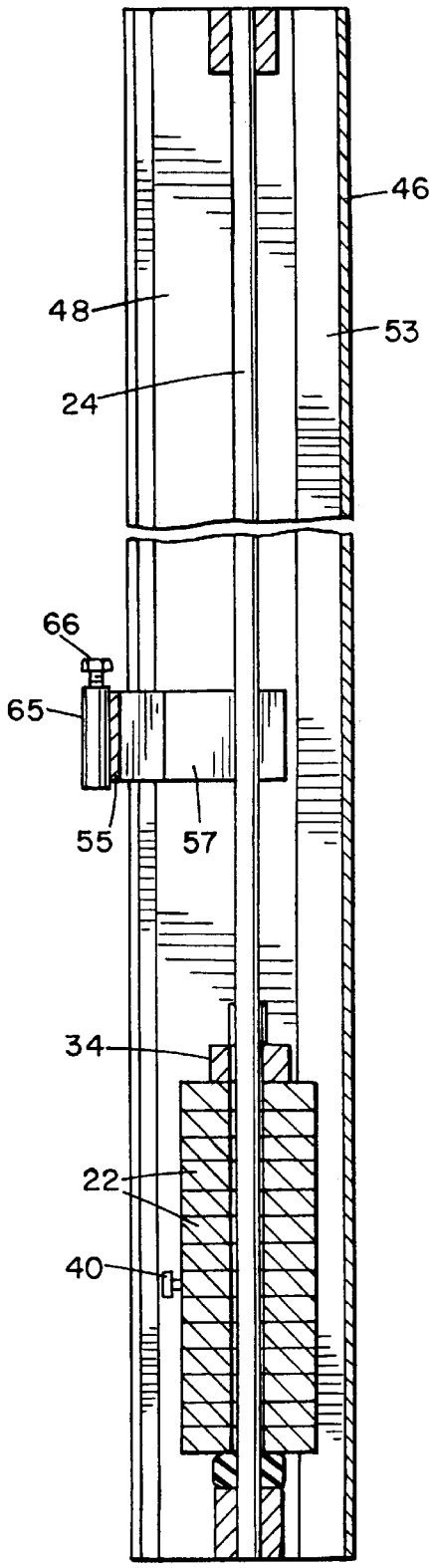
FIG. 7 is a sectional view taken on line 7—7 of FIG. 6.

The sidewalls 57 of the front bracket are engaged with the opposite side walls 48 of the main body and secured in position by suitable bolts, rivets or other fasteners 62 extending through the overlapped side walls, as indicated in FIG. 2. The main body and bracket of FIG. 4 are secured together in a similar manner, and like reference numerals are used for like parts as appropriate. The front bracket is secured at a location spaced above the adjustment region or "pinning" area of the weight stack, as best illustrated in FIGS. 1, 6 and 7. A cable attachment or location device is provided on the front wall of the front bracket in alignment with the upright member 18 and center line of the machine. In the embodiment of FIGS. 1 to 4, 6 and 7, the attachment device comprises a fastener or tie-off for the end of a cable 68. The attachment device in FIGS. 1 to 4 comprises a fastener sleeve 65 and an adjustable bolt 66 engaging one end of the sleeve to secure cable 68 in the sleeve.

As noted above, a cable and pulley assembly is used to link each exercise station to the weight stack attachment cable 36. Because some exercise stations are typically located at the upper end of the frame, while others are located at the lower end of the frame, the cable and pulley assembly will normally include portions, such as portion 70 indicated in FIG. 3, which extend from the upper end to the lower end of the frame. These portions 70 are located behind the user access area to avoid any interference with exercises performed by the user, and are thus in front of the weight stack assembly and housing. Cable 68 forms part of the portion 70 of the cable and pulley assembly running from the upper end to the lower end of the frame. By tying off the end of cable 68 in the attachment device 65, 66 as indicated in FIG. 3, this cable is held away from the pinning area of the weight stack, ensuring that the user can readily access this area to change the location of the pull pin 40 as desired. The adjustable bolt 66 can also be used to adjust the cable tension easily.

Figure 5:
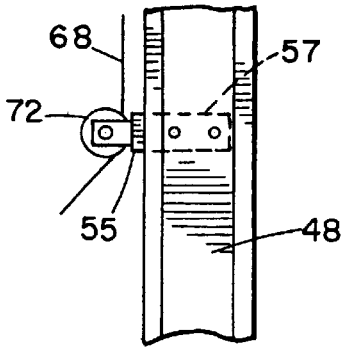
FIG. 5 is a view similar to a portion of FIG. 3, showing an alternative pulley attachment.

In the alternative illustrated in FIG. 5, attachment device or fastener 65 is replaced by a fixed pulley 72 secured to the front wall of the bracket 52. This pulley may be used to re-direct cable 68 away from the front of the weight stack, as illustrated in FIG. 5. This will also allow for easier access to the weight stack via the open side of the housing beneath the bracket 52. This alternative is otherwise identical to that of FIGS. 1 to 4, and like reference numerals have been used as appropriate. Although a single attachment device 65 is illustrated in FIGS. 1 to 3 and a single pulley in FIG. 5, the bracket 52 may have both an attachment device 65 and a pulley 72 secured side by side or at vertically spaced locations, to provide locating devices for more than one cable. Alternatively, two or more devices 65 or pulleys 72, or combinations of attachment devices and pulleys, may be mounted on the bracket.

Although the attachment device 65 and pulley 72 are centrally located on bracket 52 in the illustrated embodiment, they may alternatively be offset to either side of the illustrated position in some cases. For example, if the lower pulley 71 of the double floating pulley 73 were oriented perpendicular to the upper pulley, cable 68 would be offset from the center line, and the device 65 or pulley 72 would then be positioned in line with cable 68.

The main body of the housing 10 may also be used as a mount for a placard 74 for listing the primary exercises to be performed on the machine, as illustrated in FIG. 1. This may suitably be bolted to one side wall 48 of the main body at a location spaced above the front bracket 52.

The front support bracket acts as a cable attachment or pulley mounting point for keeping any cable from intruding on the weight stack pinning area. At the same time, the bracket acts as a stiffener for the main body of the housing, tending to resist any tendency of the side walls 48 to flex under a heavy load. The front bracket is formed separately from the main body, and releasably attached to the main body, so that the weight stack may be easily installed and serviced.

The cable attachment device on the front bracket may be used for cable running downward, cable running upward, or both. The device keeps any downward running cable away from the front of the weight stack. The main body or shield combined with the front bracket acts as an upright for structural support as well as a protective cover around the weight stack, reducing the risk of injury. The two part housing 10 is designed to mount directly in-line and behind the exerciser, not offset to one side of the exerciser as has been done in the past to provide access to the weight stack adjustment or pinning area. Housing 10 provides a cable attachment or location point above the adjustment or pinning area so that the housing and weight stack can be located directly behind and in line with the exerciser while still providing ready access to the adjustment area, as best illustrated in FIG. 1.

The front support bracket 52 leaves the front of the housing open along most of its length, while providing rigidity to the main body 44 and providing a cable location point above the weight stack adjustment area. This avoids the need to offset either the weight stack or the cable assembly from the center line of the machine directly behind the user. Both of these alternatives have been used in the past as solutions to the problem of access to the weight stack adjustment or pinning area, but are undesirable in view of the necessarily increased size of the machine, and also due to increased cable length requirements and off center cable operation, which is less smooth, in the case of offset cable assemblies.

Both the main body 44 and front bracket 52 of the housing may be formed from suitable sheet metal bent into the desired, multi-sided U-shape. The housing is therefore simple and inexpensive in construction, while providing a safe enclosure for the weight stack with ready access by the user for adjustment purposes without increasing the space required for the exercise machine.

Although a preferred embodiment of the invention has been described above by way of example only, it will be understood by those skilled in the field that modifications may be made to the disclosed embodiment without departing form the scope of the invention, which is defined by the appended claims.

I claim:

1. A weight stack apparatus for an exercise machine, comprising:

a weight stack assembly having a pinning area;

an elongate shield body forming an enclosure for three sides of the weight stack assembly, the body having a front opening having opposite sides and being adapted for attachment between the top and bottom of the frame of an exercise machine in alignment with a user access area of the machine;

a front support bracket secured between the sides of the front opening in the shield body to extend across the open front of the shield body at a location spaced above the weight stack pinning area of the weight stack enclosed in the housing, the bracket having an outer surface and a lower edge spaced above the weight stack pinning area of a weight stack enclosed in the housing, whereby the front of the shield body is open below the bracket for access to the weight stack pinning area;

an outwardly facing attachment device secured directly to the outer surface of the bracket above the weight stack pinning area for attaching a cable to the support bracket, whereby the cable can be attached above the weight stack pinning area and does not impede access to the weight stack pinning area; and the main shield body and front bracket each being generally U-shaped in cross-section, the shield body having a rear wall and a pair of side walls, and the front bracket having a front wall extending across the open front of the shield body, and opposite side walls engaging the respective opposite side walls of the shield body.

2. The apparatus as claimed in claim 1, wherein the attachment device comprises a fastener for tying off the end of a cable.

3. The apparatus as claimed in claim 1, wherein the attachment device comprises a pulley rotatably secured to the front of the support bracket, for re-directing cable away from the front of the weight stack.

4. The apparatus as claimed in claim 1, wherein the shield body has at least five sides, comprising a rear wall, side walls, and an angled corner wall extending between each side wall and the rear wall.

5. The apparatus as claimed in claim 1, including at least one releasable fastener securing each side wall of the front bracket to the respective side wall of the shield body.

6. The apparatus as claimed in claim 1, wherein the shield body and front bracket each have angled corner portions connecting the respective side walls to the rear and front walls, respectively, of the main body and front bracket, whereby the shield body and front bracket together form an eight-sided cross section.

7. An exercise apparatus, comprising:

a support frame having an upper end, a lower end, a front end, and a rear end, and defining a user access area;

at least one exercise device mounted on the frame for permitting a user in the access area to perform an exercise;

a weight stack assembly mounted on the frame behind the user access area, the weight stack assembly having a pinning area for adjustment of the exercise resistance;

an elongate shield body forming an enclosure extending around three sides of the weight stack assembly, the body having a front opening having opposite sides, and being attached between the upper and lower end of the frame in alignment with the user access area;

a front support bracket secured between the sides of the front opening in the shield body to extend across the open front of the shield body at a location spaced above the weight stack pinning area, whereby the front of the shield body is open below the bracket for access to the weight stack pinning area;

an outwardly facing attachment device secured directly to the outer surface of the bracket above the weight stack pinning area for attaching a cable to the support bracket, whereby the cable can be attached above the weight stack pinning area and does not impede access to the weight stack pinning area;

the attachment device comprising a fastener for tying off the end of a cable; and the fastener comprising a fastener sleeve and an adjustable bolt for adjustably securing a cable end in the sleeve and adjusting cable tension.

8. The apparatus as claimed in claim 7, wherein the shield body of the housing has at least three sides, comprising a rear wall and a pair of side walls, the bracket being secured between the side walls.

9. An exercise apparatus, comprising:

a support frame having an upper end, a lower end, a front end, and a rear end, and defining a user access area;

at least one exercise device mounted on the frame for permitting a user in the access area to perform an exercise;

a weight stack assembly mounted on the frame behind the user access area, the weight stack assembly having a pinning area for adjustment of the exercise resistance;

an elongate shield body forming an enclosure extending around three sides of the weight stack assembly, the body having a front opening having opposite sides, and being attached between the upper and lower end of the frame in alignment with the user access area;

a front support bracket secured between the sides of the front opening in the shield body to extend across the open front of the shield body at a location spaced above the weight stack pinning area, whereby the front of the shield body is open below the bracket for access to the weight stack pinning area;

an outwardly facing attachment device secured directly to the outer surface of the bracket above the weight stack pinning area for attaching a cable to the support bracket, whereby the cable can be attached above the weight stack pinning area and does not impede access to the weight stack pinning area; and the shield body and front bracket each being generally U-shaped in cross-section, the shield body having a rear wall and a pair of side walls, and the front bracket having a front wall extending across the open front of the shield body, and opposite side walls engaging the respective opposite side walls of the shield body.

* * * * *